US005950640A

United States Patent [19]

Duncan et al.

[11] Patent Number: 5,950,640

[45] **Date of Patent: *Sep. 14, 1999**

[54] COSMETIC CONTAINER HAVING A MAGNIFYING MIRROR AND A PLAIN MIRROR

[76] Inventors: Christina M. Duncan; Marie B. Duncan, both of Box 595217, Dallas, Tex. 75359

[ * ] Notice: This patent is subject to a terminal disclaimer.

[21] Appl. No.: 08/802,999

[22] Filed: Feb. 21, 1997

[51] Int. Cl.[6] ..... A45D 42/02

[52] U.S. Cl. ..... 132/305; 132/316

[58] Field of Search ..... 132/301, 304, 132/305, 315, 316, 302, 303, 306, 296; 359/840, 850, 855, 864, 871

[56] References Cited

U.S. PATENT DOCUMENTS

| | | | |
|---|---|---|---|
| D. 331,818 | 12/1992 | Holahan et al. . | |
| 1,229,285 | 6/1917 | Kendall . | |
| 1,455,647 | 5/1923 | Morrison | 132/296 |
| 1,456,636 | 5/1923 | Kendall | 132/296 |
| 1,512,005 | 10/1924 | Wright . | |
| 1,525,665 | 2/1925 | Slover et al. . | |
| 1,629,966 | 5/1927 | Reutter | 132/296 |
| 1,685,908 | 10/1928 | Coryell | 132/295 |
| 1,806,303 | 5/1931 | McAtree | 132/301 |
| 1,989,155 | 1/1935 | Rosenberg . | |
| 2,421,646 | 6/1947 | Pepin . | |
| 2,911,177 | 11/1959 | West | 359/864 |
| 2,916,967 | 12/1959 | Husak | 359/855 |
| 3,006,252 | 10/1961 | Kacowski | 359/864 |
| 3,267,806 | 8/1966 | Azegami | 359/864 |
| 3,949,767 | 4/1976 | Rose . | |
| 3,996,947 | 12/1976 | Szpur et al. . | |
| 4,936,463 | 6/1990 | Tiramani | 132/315 |
| 5,218,978 | 6/1993 | Yang et al. | 132/296 |
| 5,563,744 | 10/1996 | Matsumiya | 359/864 |
| 5,611,362 | 3/1997 | Duncan et al. | 132/301 |

FOREIGN PATENT DOCUMENTS

| | | | |
|---|---|---|---|
| 2915521 | 10/1980 | Germany | 359/864 |
| 764125 | 12/1956 | United Kingdom . | |

*Primary Examiner*—Gene Mancene
*Assistant Examiner*—Eduardo C. Robert
*Attorney, Agent, or Firm*—Akin, Gump, Strauss, Hauer & Feld, L.L.P.

[57] ABSTRACT

A mirrored cosmetic container includes a body portion having a cosmetic well and a top cover hinged to the body portion for covering the well. Interchangeable plain and magnifying mirrors may be mounted in recesses in the inside of the top cover and opening to the bottom side of the body portion. Removable bezel retainers are operable to retain the mirrors in their working positions in their respective recesses. The cosmetic container may have a combination mirror disposed inside the top cover with a magnifying and plain mirror arranged side by side, or one over the other or one inset in the other, for example.

7 Claims, 4 Drawing Sheets

COSMETIC CONTAINER HAVING A MAGNIFYING MIRROR AND A PLAIN MIRROR

FIELD OF THE INVENTION

The present invention pertains to a cosmetic container or compact having an arrangement of a combination magnifying mirror and plain mirror in the inside of the top cover or a plain mirror in the inside of the top cover and a magnifying mirror on the outside of the bottom cover or body of the container. The mirrors may be interchangeable.

BACKGROUND

Our prior U.S. Pat. No. 5,611,362 issued Mar. 8, 1997, the subject matter of which is incorporated herein by reference, describes a mirrored cosmetic container or compact having an advantageous arrangement of a magnifying mirror disposed on the inside of the top cover and a plain mirror disposed on the outside of the bottom cover or body of the container. This arrangement of mirrors in a cosmetic container or compact is advantageous for the reasons set forth in the above referenced patent application. However, there are persons who prefer to have both a magnifying mirror and a plain mirror disposed on the inside of the top cover of the container and there are persons who prefer to have the plain mirror on the inside of the top cover and a magnifying mirror on the outside of the bottom cover. Certain advantages for such mirror arrangements are discussed further herein.

Accordingly, the present invention meets the desiderata of these mirror arrangements as will be further appreciated by those skilled in the art upon reading the summary and detailed description which follows.

SUMMARY OF THE INVENTION

The present invention provides a cosmetic container or compact having a body portion for holding a quantity of a cosmetic, such as face powder, a cover hinged to the body portion for closing the container and improved arrangements of both magnifying mirrors and plain mirrors, respectively.

In accordance with one aspect of the present invention a cosmetic container is provided which has a top cover which is closeable over a bottom cover or body portion and the interior of the top cover has disposed therein both a plain mirror and a magnifying mirror arranged side by side, or one above the other or a magnifying mirror inset in a plain mirror.

In accordance with another aspect of the present invention a cosmetic container is provided having a body portion or bottom cover and a top cover hinged thereto and wherein a magnifying mirror may be disposed on the outside of the body portion and a plain mirror may be disposed on the inside of the top cover. The outside mirror may be protected by a movable outer cover.

Still further, the present invention provides an improved cosmetic container wherein a mirror is provided on the inside of the top cover and a mirror is provided on the outside of the bottom cover and both mirrors are retained in their working positions by removable bezels or the like and whereby the working positions of the mirrors may be interchanged. In this way persons desiring to have a plain mirror or a magnifying mirror in one or the other locations on the cosmetic container may interchange the mirrors, at will.

Certain advantages of having a combination plain mirror and magnifying mirror on the inside of the top cover include one wherein the user may examine the application of cosmetics closely when viewing the magnifying mirror and then also take a more general view of their person through the plain mirror. The arrangement of the plain mirror and the magnifying mirror may be according to personal preference, such as having the mirrors side by side or one over the other in the normal orientation of the cosmetic container when the top cover is open during application of cosmetics to and/or inspection of one's person.

Advantages of the embodiment of the invention wherein the mirrors may be interchanged include one wherein those persons preferring to have the magnifying mirror on the outside of the container and the plain mirror on the inside may do so while, on the other hand, a cosmetic container is provided which permits interchanging the mirrors, at will, to place either mirror in a location of personal preference. Other advantages of the mirror arrangements of the present invention are discussed hereinbelow.

Those skilled in the art will further appreciate the advantages and superior features of the invention together with other important aspects thereof upon reading the detailed description which follows in conjunction with the drawing.

DETAILED DESCRIPTION OF THE PREFERRED EMBODIMENTS

Figure 1:
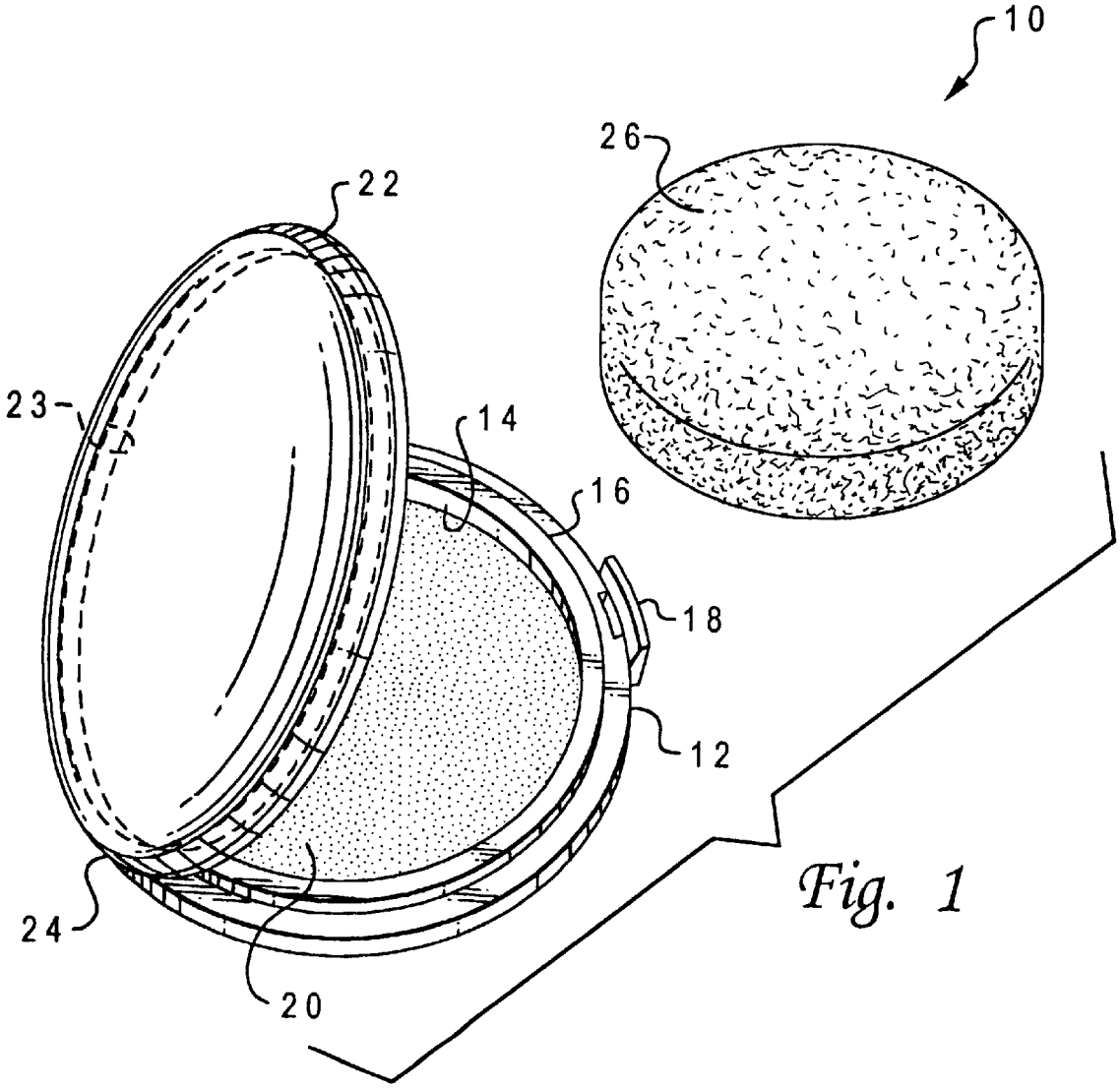
FIG. 1 is a perspective view of a cosmetic container and cosmetic applicator in accordance with the present invention.

In the description which follows like elements are marked throughout the specification and drawing with the same reference, numerals, respectively. The drawing figures are not necessarily to scale and certain elements may be shown in generalized or schematic form in the interest of clarity and conciseness.

Referring to FIG. 1, there is illustrated a cosmetic container in accordance with the present invention and generally designated by the numeral 10. The cosmetic container 10 includes a generally cylindrical or circular cup-like bottom cover or body portion 12 having a generally cylindrical recess or cosmetic well 14 formed therein. The body portion 12 may be formed with a generally cylindrical rim or integral collar portion 16 and a suitable clasp member 18 as shown. The cosmetic well 14 is preferably adapted to hold a quantity of a cosmetic, such as face powder 20, as shown in FIG. 1. The body portion 12 is connected to a generally circular, shallow shell-like top cover member 22 by conventional hinge means 24. The top cover 22 includes a suitable circular recess 23 formed therein for supporting an improved mirror arrangement. The body portion 12 and top cover 22 may be fabricated of conventional materials used for cosmetic containers or compacts, such as metal or plastic, and may have suitable decorative indicia placed thereon, not shown. The recesses 23 and 14 in the top cover 22 and the body 12, respectively, are also cooperable for receiving a cosmetic applicator or applicators, such as a powder puff 26, retained therein when the cover 22 is closed to engage the clasp 18. The body portion 12 and the top cover 22 are shown of a generally circular or cylindrical configuration. However, these members may be fabricated in other shapes, including, but not limited to, generally rectangular or oval configurations. The structural features of the clasp 18 and the hinge 24 do not form a part of the present invention and may be of conventional construction associated with convetional cosmetic containers.

Figure 2:
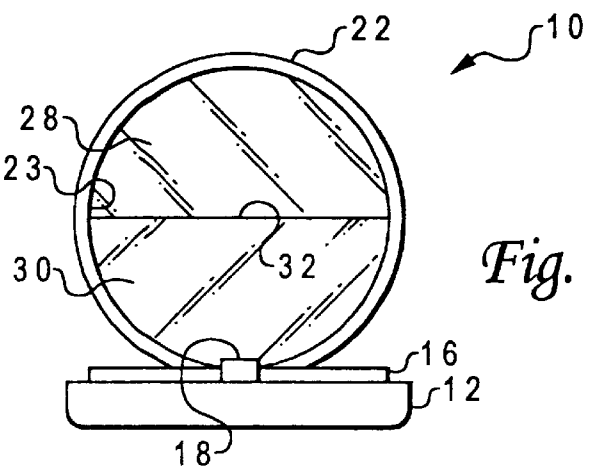
FIG. 2 is a front elevation of the container shown in FIG. 1 with the top cover open and showing one preferred arrangement of a combination plain mirror and magnifying mirror.

One preferred arrangement of mirrors for a cosmetic container, similar to the container 10, is described and claimed in the above referenced patent application. This arrangement is one wherein the interior of the top cover supports a magnifying mirror and the outside surface of the bottom cover or bottom side of the container is adapted to support a plain mirror thereon. However, the cosmetic container 10, as shown in FIG. 2, is adapted to provide other mirror arrangements, as shown, wherein the inside surface of the top cover 22 is adapted to support a combination of two mirrors in recess 23 including a magnifying mirror 28 disposed above a plain mirror 30. The mirrors 28 and 30 are shown as semi-circular mirrors and are contiguous with each other along a diametral line 32 so that both mirrors may be viewed easily when the cosmetic container is in a partially open position, as shown, with the top cover 22 oriented at a substantially right angle to the body portion 12. However, for normal use the top cover 22 is usually moved to a more fully open position up to, for example, being substantially coplanar with the body portion 12. In this way a person using the cosmetic container 10 may open the top cover 22, remove the applicator 26 from the cosmetic well 14 and apply cosmetics as desired while viewing the magnifying mirror 28, or the plain mirror 30. Prior to closing the top cover 22 over the body portion 12, a final overall view of the portion of the persons body to which cosmetics have been applied may be easily viewed through the mirror 30. Moreover, the position of the mirrors 28 and 30 may be reversed, that is the magnifying mirror 28 may be placed where the plain mirror 30 is located in FIG. 2, and the plain mirror placed where the magnifying mirror is shown in FIG. 2.

Figure 3:
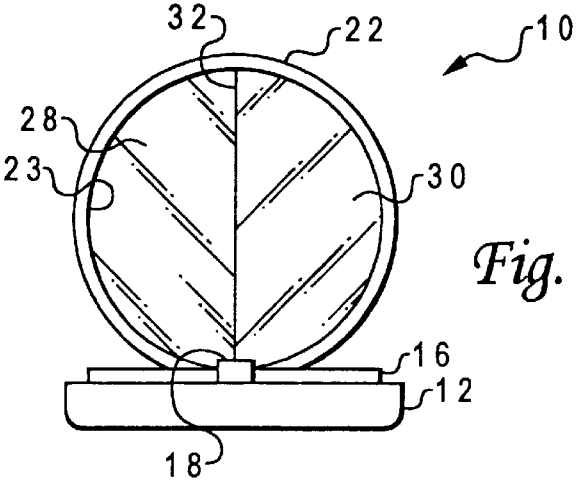
FIG. 3 is a front elevation of the cosmetic container shown in FIGS. 1 and 2 with a different orientation of a combination plain mirror and magnifying mirror.

Alternatively, as shown in FIG. 3, the magnifying mirror 28 and plain mirror 30 may be oriented in a left to right orientation or vice versa. As shown in FIG. 3, the magnifying mirror 28 is disposed in recess 23 on the left side of the top cover 22 when it is in an open position with the cosmetic well 14 facing upward and the plain mirror 30 is shown on the right side. This orientation may be reversed, if desired.

As previously discussed, one advantage of the arrangement of both a magnifying mirror and a plain mirror, as shown for the cosmetic container 10 in FIGS. 2 and 3, is that a person may use the magnifying mirror for close up inspection during application of cosmetic or for other purposes and also use the plain mirror for a wider viewing range without closing the cosmetic container. Moreover, certain cosmetic containers may include a number of different cosmetics and applicators in the cosmetic well, such as a pallet of eye shadow and lip colors with one or more applicators for each type. When using such containers, one is continuously mixing the cosmetics, applying the mixture to the face, viewing the application, then remixing, reapplying, reviewing, etc., until the desired effect is achieved. Having both mirrors located side by side, one over the other or one inset in the other is advantageous because a person using the container would simply have to tilt or move one's face back and forth slightly after each adjustment to view the mirror of choice. Having the mirrors located conveniently side by side, in particular, would also provide for avoiding moving the container hardly at all, which would help keep the applicators, as well as possibly the individual tubs of cosmetics from falling out of the container.

The mirrors 28 and 30 may not necessarily be of equal area, that is, the line 32 may not be a diametral line, for example. The mirrors are not required to be mounted on a separate support structure but are advantageously placed on the inside of the top cover and may be supported therein in a conventional manner, such as by an adhesive, by being snapped fitted into the generally circular recess 23 in the top cover or by suitable retainer means described in conjunction with the embodiment of FIGS. 4 through 6 herein, for example.

It may also be desirable to provide a cosmetic container of the general type described herein and in our prior patent application wherein the magnifying mirror is disposed on the outside of the bottom of the body portion or bottom cover and the plain mirror is disposed on the inside of the top cover. For example, if the user of such a cosmetic container applied other cosmetics or beauty products more frequently than those which were contained in the cosmetic container itself, such as lipstick or eye shadow from separate containers. Placing the magnifying mirror on the outside of the bottom cover or body portion of the cosmetic container would also be advantageous if the user required reading glasses for close viewing but preferred not to wear such glasses. In this case, quick checks of the face and make-up could still be made with ease without opening the container. It would also be advantageous if the user had frequent need for a magnifying mirror for purposes other than applying cosmetics, such as inserting or removing contact lenses, applying medication to the eye or removing a foreign object from the eye. In such instances, not having to open the cosmetic container when cosmetics are not needed would simplify the task at hand.

Moreover, it is also advantageous to be able to interchange the mirrors to suit one's personal preference, to provide for temporary placement of a mirror in a desired position, if for any reason one of the mirrors is damaged, and to replace either or both of the mirrors, when desired. In this regard an alternate embodiment of the present invention is illustrated in FIGS. 4 through 6.

Figure 6:
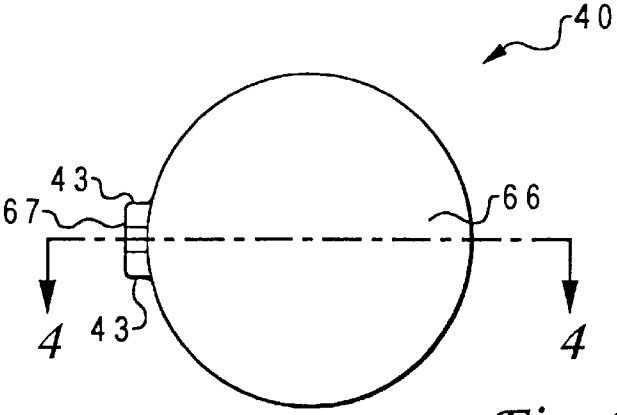
FIG. 6 is a top plan view of the cosmetic container shown in FIG. 4.
Figure 5:
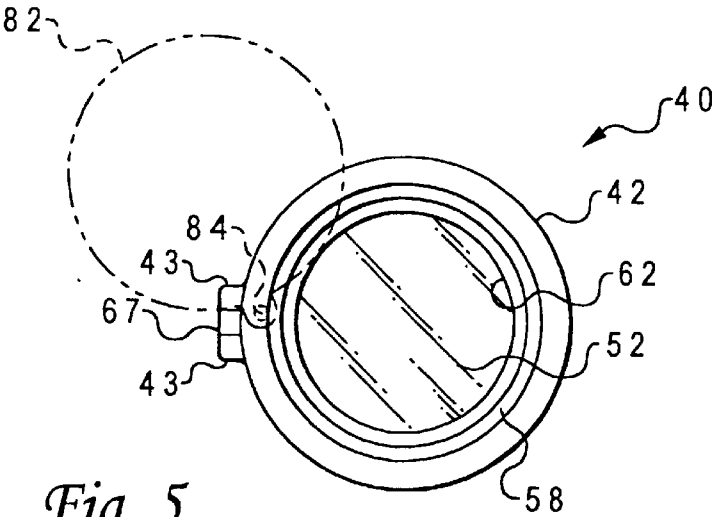
FIG. 5 is a bottom plan view of the cosmetic container shown in FIG. 4.
Figure 4:
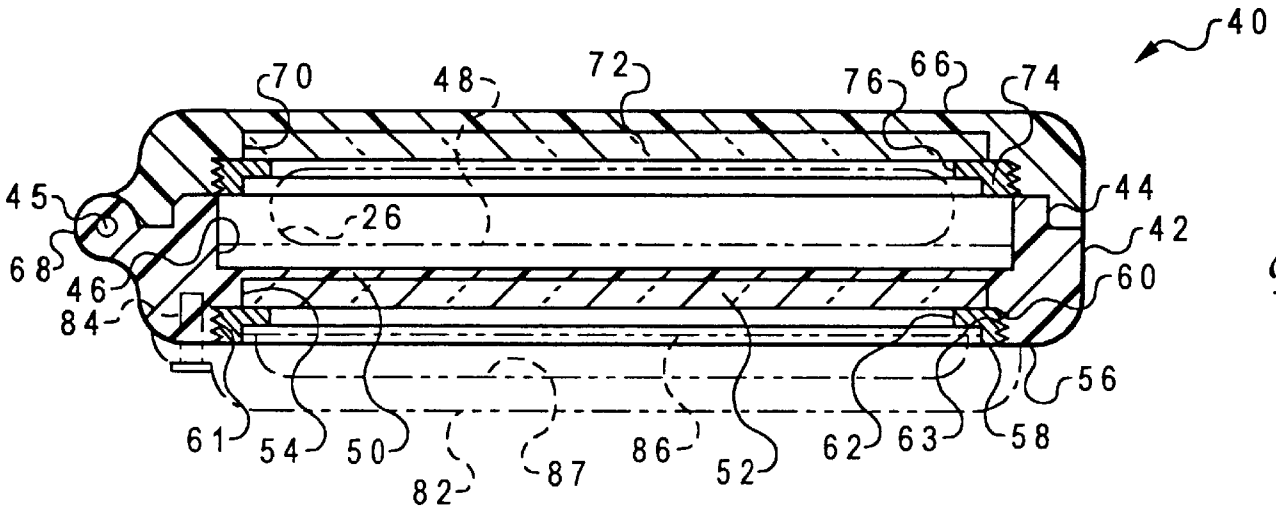
FIG. 4 is a section view taken generally along the line 4—4 of FIG. 6 of a first alternate embodiment of a cosmetic container or compact in accordance with the present invention.

Referring to FIGS. 4 through 6, a cosmetic container 40 is illustrated, which is similar in some respects to the container 10 in that it includes a generally circular or cylindrical bottom cover or body portion 42 having a peripheral integral collar 44 formed thereon and delimiting a cosmetic recess or well 46 which is also of a generally cylindrical configuration and contains a quantity of cosmetic, such as face powder 48, therein. The body portion 42 includes a transverse wall 50 forming a bottom of the cosmetic well 46 and which is also adapted to support a generally circular magnifying mirror 52 within a generally circular recess 54 formed in the bottom side 56 of the bottom cover or body portion 42. The mirror 52 is retained in the recess 54 by a suitable retainer, such as a cylindrical ring bezel 58, which has suitable external threads 60 formed thereon and cooperable with internal threads 61 formed in a recess 63 in the body portion 42, as shown. The bezel 58 has an inner diameter 62 delimiting the bezel so that a circular area defined by the inner diameter of the bezel provides for viewing the mirror 52. The bezel 58 may be easily connected to or disconnected from the body 42 for removing the mirror 52 from the recess 54, at will. The bezel 58 may also be of a type which is a slight interference fit in recess 63 of the body 42 and whereby threads 60 and 61 may be eliminated. In other words, the bezel 58 may, if desired, be a snap in snap out type fit in the recess 63 for retaining the mirror 52 in the recess 54.

Referring further to FIGS. 4 and 6, the cosmetic container 40 has a generally cylindrical top cover 66 which is hinged to the body portion 42 at suitable hinge means 68. For example, the body portion 42 may have spaced apart integral hinge bosses 43, FIGS. 5 and 6, and the top cover 66 provided with a single integral hinge boss 67 disposed between the hinge bosses 43 and wherein the top cover 66 is secured to the body portion 42 by a hinge pin 45, FIG. 4, extending through the bosses 43 and 67.

The top cover 66 is also provided with a circular recess 70 for receiving a generally circular plain mirror 72 therein and retained in the recess 70 by a retainer, such as another circular ring bezel 74 substantially like the bezel 58. The retainers or bezels 58 and 74 may, for example, be identical in construction and have external threads formed thereon together with an inner diameter, such as the diameters 62 and 76 which permit viewing a substantial portion of the areas of the respective mirrors 52 and 72. Accordingly, when the cover 66 is moved to an open position, similar to that described above for the cosmetic container 10, access to the cosmetic well 46 may be obtained to apply cosmetic to an applicator 26, shown disposed in the container in FIG. 4, and the mirror 72 may be viewed during application of the cosmetic.

Preferably, the container 40 is closed to the position shown in FIG. 4 before turning the body portion 42 to a position where the mirror 52 can be viewed, although this may not be necessary. Of course, the mirrors 52 and 72 may be interchanged, at will, by removing the respective bezels 58 and 74, interchanging the mirrors and replacing the bezels to support the mirrors in their respective working positions. Moreover, if desired, the mirrors 52 and 72 may be of a split or combination configuration similar to the mirrors 28 and 30 wherein one portion of the mirror is a magnifying mirror and another portion is a plain mirror. In fact, the mirrors 28 and 30 may be used in the cosmetic container 40 in place of the mirrors 52 and 72, if the dimensions of the respective mirrors are the same, of course.

As mentioned previously the bezels 58 and 74 may, if desired, be a snap-in and snap-out type fit in the respective recesses for retaining the mirrors 52 and 72. Other means for retaining the bezels may be employed and other means for retaining the mirrors in the recesses, including pressure sensitive adhesives, for example, may also be employed.

Figure 4A:
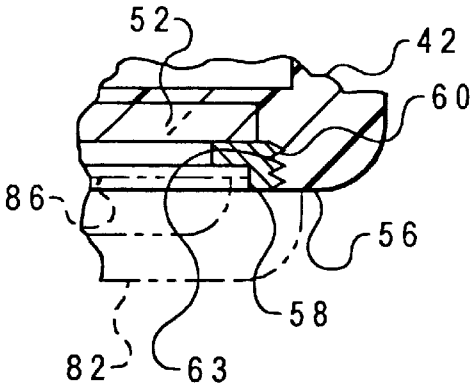
FIG. 4A is a detail section view of the container shown in FIG. 4 on a larger scale.

Referring again to FIGS. 4, 4A and 5, in certain instances, it may be desirable to have a movable cover disposed over the mirror 52 at the bottom side 56 of the body portion 42. Such a second cover is indicated by the dashed lines in FIGS. 4 and 5 and is generally designated by the numeral 82. The outside cover 82 may be pivotally supported on the body portion 42 by a pivot pin 84 and may include an annular rim 86 which fits within the bezel 58 in somewhat of a snap fit. The cover 82 may be provided with a cosmetic or applicator storage well 87 formed between the cover and the mirror 52, for example.

The cover 82 may be grasped and slightly deflected at a point opposite the pin 84 to allow for snapping the rim 86 out of the recess in the bezel 58 whereby the cover may then be pivoted to the position shown in FIG. 5 so that the mirror 52 is fully viewable. The pin 84 may be a threaded member, such as a conventional panhead machine screw, for example, whereby, when it is desired to remove the bezel 58 from the body portion 42, the pin and the cover 82 would be removed from the body portion and then replaced when the bezel 58 was replaced in its working position shown. The cover 82 could, of course, also be configured to be hinged for movement about the axis of the hinge pin 45.

The cosmetic container 40 may also be fabricated of conventional materials for both the body portion 42 and cover 66 as well as the bezels 58 and 74. Moreover, the mirrors 52 and 72 may be constructed using conventional techniques for cosmetic container mirrors and the like. As with the cosmetic container 10, the container 40 need not be required to be substantially circular or cylindrical, as shown, but may be other shapes, including oval, or elliptical, or generally rectangular, for example. In this regard, the retainers or bezels 58 and 74, if shaped to conform to the outline of the container and cover, would preferably be of a snap in or interference fit in their respective body portion and cover recesses so that the mirrors could take the general geometric shape of the body portion and top cover, respectively.

Figure 7:
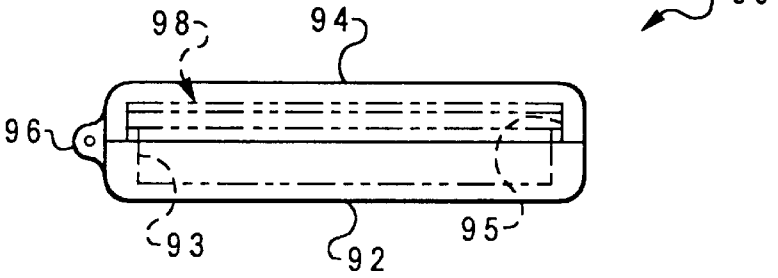
FIG. 7 is a side view of a second alternate embodiment of a cosmetic container in accordance with the invention with the top cover in a closed position.
Figure 8:
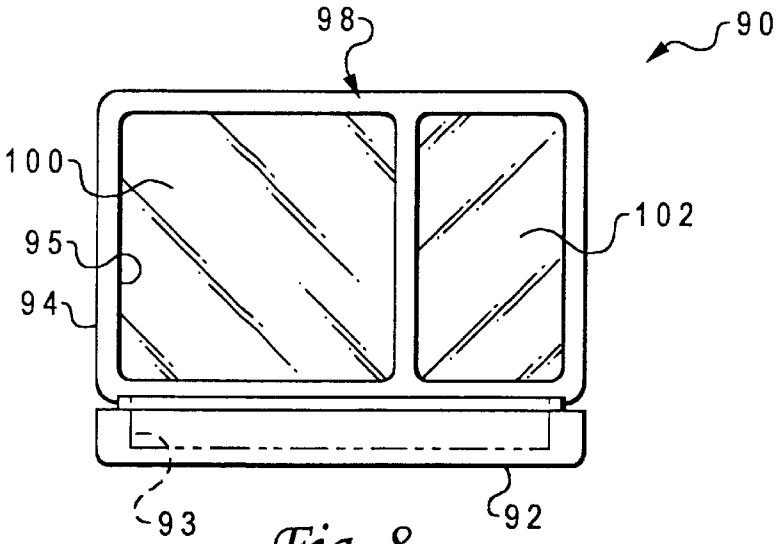
FIG. 8 is a front elevation of the cosmetic container shown in FIG. 7 with the top cover in a partially open position.

Referring now to FIGS. 7 and 8, another embodiment of a cosmetic container in accordance with the invention is illustrated and generally designated by the numeral 90. The cosmetic container 90 is characterized by a body portion 92 including a cosmetic receptacle or well 93 formed therein and otherwise being similar in general configuration to the body portion 12 of the cosmetic container 10, but being generally rectangular. The body portion 92 is hinged to a top cover 94 at a hinge 96. The cosmetic container 90 is shown in a partially open position in FIG. 8 wherein a generally rectangular combination plain mirror and magnifying mirror 98 is illustrated disposed within a generally rectangular recess 95 inside the top cover 94. The combination plain mirror and magnifying mirror 98 includes a generally rectangular plain mirror 100 and a magnifying mirror 102. The plain mirror 100 may be approximately sixty percent to seventy percent of the total mirror area while the magnifying mirror 102 is disposed beside the plain mirror and occupies between thirty percent to forty percent of the total mirror area. In most other respects the cosmetic container 90 is similar to the cosmetic container 10.

Figure 9:
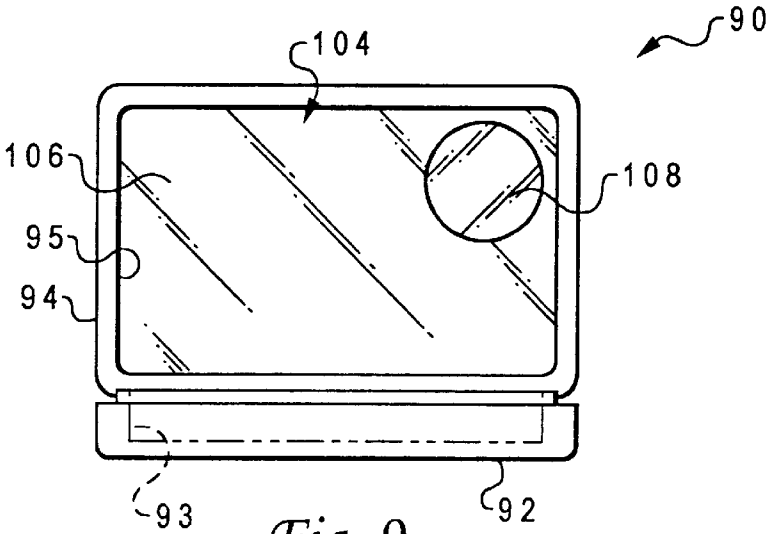
FIG. 9 is a view similar to FIG. 8 showing an arrangement of a magnifying mirror inset in a plain mirror.

Referring briefly to FIG. 9, yet another embodiment of a combination plain mirror and magnifying mirror is shown disposed in the cover 94 of the cosmetic container 90 in place of the mirror 98. In the arrangement of FIG. 9 a combination mirror 104 includes a generally rectangular plain mirror 106 occupying the entire recess 95 of the top cover 94 and having a magnifying mirror 108 inset in the plain mirror. Accordingly, the plain mirror is that portion of the mirror 104 designated by numeral 106 and the magnifying mirror is the generally circular mirror 108. The mirrors 98 or 104 may be retained in the cover 94 by one of the aforementioned means. The mirrors 100, 102, 106 and 108 may be of other shapes than those illustrated, and the position of one with respect to the other may be varied as previously discussed.

Although preferred embodiments of the invention have been described in detail herein, both skilled in the art will recognize that various substitutions and modifications may be made to the invention without departing from the scope and spirit of the appended claims.

What is claimed is:

1. A cosmetic container comprising:

a body portion including a cosmetic well formed therein and a bottom side of said body portion;

a top cover connected to said body portion for movement between an open position of said cosmetic well and a closed position;

a plain mirror disposed in an inside recess of said top cover and being viewable by a person holding said cosmetic container when said top cover is in an open position with respect to said cosmetic well; and a magnifying mirror disposed in a recess formed on said bottom side of said body portion and being viewable by a person holding said cosmetic container without opening a part of said cosmetic container which includes a cosmetic well.

2. The cosmetic container set forth in claim 1 wherein:

at least one of said mirrors is a combination magnifying mirror and plain mirror.

3. The cosmetic container set forth in claim 1 including:

a cover supported on said cosmetic container and movable to a position to close over said mirror disposed on said bottom side of said body portion.

4. The cosmetic container set forth in claim 1 including:

a retainer for retaining said plain mirror on said top cover and a retainer for retaining said magnifying mirror on said body portion, said retainers being removable from said top cover and said body portion, respectively, for interchanging the positions of said mirrors whereby said magnifying mirror may be placed inside said top cover and said plain mirror may be placed on said bottom side of said body portion.

5. The cosmetic container set forth in claim 4 wherein:

said retainers comprise bezels, respectively.

6. A cosmetic container comprising a body portion having a cosmetic well formed therein, said body portion having a bottom side, a recess formed in said bottom side for receiving a magnifying mirror and a retainer for releaseably retaining said magnifying mirror in said recess in said body portion for viewing by a person holding said cosmetic container without opening a cosmetic well of said cosmetic container;

a top cover of said cosmetic container for covering said cosmetic well, said top cover being hinged to said body portion for movement between a closed position for covering said cosmetic well and an open position;

said top cover including a recess opening to an inside of said top cover for receiving a plain mirror therein and a retainer for releaseably retaining said plain mirror in said recess in said top cover; and said magnifying mirror and said plain mirror being repeatedly interchangeable in said recesses, at will, by removing and replacing said retainers, respectively, whereby said plain mirror may be retained in said recess in said body portion or said top cover and said magnifying mirror may be retained in said recess in said top cover or said body portion.

7. The cosmetic container set forth in claim 6 including:

a cover supported on said cosmetic container and movable to a position to close over said mirror disposed in said recess in said body portion.

* * * * *